United States Patent [19]

Vauquelin

[11] Patent Number: 4,955,745

[45] Date of Patent: Sep. 11, 1990

[54] BOTTLE WITH APPLICATOR

[76] Inventor: Jeri A. Vauquelin, 1742 S. Bentley Ave., #302, Los Angeles, Calif. 90025

[21] Appl. No.: 417,434

[22] Filed: Oct. 5, 1989

[51] Int. Cl.[5] ..... A45D 34/00; A46B 11/00

[52] U.S. Cl. ..... 401/119; 141/24; 401/126; 401/129

[58] Field of Search ..... 401/119, 126, 129, 130, 401/120, 153; 141/22, 23, 24

[56] References Cited

U.S. PATENT DOCUMENTS

| | | | |
|---|---|---|---|
| 376,397 | 1/1888 | Rowland . | |
| 571,367 | 11/1896 | Higgins . | |
| 1,193,433 | 8/1916 | Searchy . | |
| 1,803,713 | 5/1931 | Langsner | 401/119 |
| 1,917,568 | 7/1933 | Wupper | 401/153 |
| 1,943,804 | 1/1934 | Rummler | 401/119 |
| 2,917,766 | 12/1959 | Ciffo . | |
| 3,086,820 | 4/1963 | Baumgartner . | |
| 3,369,854 | 2/1968 | Ferris | 401/119 |
| 3,820,576 | 6/1974 | Torrent | 401/126 X |

FOREIGN PATENT DOCUMENTS

| | | | |
|---|---|---|---|
| 681107 | 3/1964 | Canada | 401/130 |
| 359277 | 9/1921 | Fed. Rep. of Germany | 401/130 |
| 219730 | 6/1942 | Switzerland | 401/129 |
| 403184 | 8/1965 | Switzerland | 401/129 |
| 6564 | of 1894 | United Kingdom | 401/126 |
| 399343 | 10/1933 | United Kingdom | 401/119 |

*Primary Examiner*—Steven A. Bratlie
*Attorney, Agent, or Firm*—Jerry T. Kearns

[57] ABSTRACT

A bottle has an applicator designed for use in applying nail polish. The interior walls of the bottle are sloped to direct the nail polish to the applicator tip. In a first embodiment, the front exterior wall and the bottom exterior surface of the bottle form a forty five degree angle. In a second embodiment, the front exterior wall and the bottom exterior surface of the bottle form a sixty degree angle. A fingernail shaped absorbent foam tip is attached to one end of the applicator shaft. The opposite end of the shaft is attached to a snap on cap for the bottle. The bottle has a volume of seven to nine ml., thus ensuring that the entire volume of nail polish may be utilized before degradation. The cap has concave recesses to facilitate manipulation of the applicator by a user. In a third embodiment, the applicator is in the form of an eye dropper type tube with an enlarged collector cavity adjacent a lower end. The applicator is actuated by a push button cap.

20 Claims, 5 Drawing Sheets

BOTTLE WITH APPLICATOR

BACKGROUND OF THE INVENTION

1. Field of the Invention

The present invention relates to bottles with applicators, and more particularly pertains to a new and improved nail polish bottle with applicator which has sloping interior walls to direct the nail polish to the tip of the applicator. Conventional nail polish bottles have a volume capacity of between eleven ml. and fifteen ml. Due to evaporation of the solvent vehicle when the cap is removed, the contents of these conventional sized nail polish bottles cannot be completely utilized before the nail polish is degraded to a large extent. Additionally, these conventional nail polish bottles have flat inner bottom walls such that the nail polish is not directed adjacent the tip of the applicator. This necessitates inconvenient and time consuming manipulation of the applicator in attempting to access the contents of the bottle. In order to overcome these difficulties, the present invention provides a seven ml. to nine ml. volume nail polish bottle which has sloping interior walls to direct the contents to a point adjacent the applicator tip.

2. Description of the Prior Art

Various types of bottles with applicators are known in the prior art. A typical example of such a bottle with applicator is to be found in U.S. Pat. No. 376,397, which issued to C. Rowland on Jan. 10, 1888. This patent discloses a generally conical bottle having an applicator brush with a spherical stop for resting in a circular opening at the top of the bottle. U.S. Pat. No. 571,367, which issued to C. M. Higgins on Nov. 17, 1896, discloses a bottle having a cap with an attached applicator brush. The bottom interior wall of the bottle is upwardly convex, which tends to direct the contents of the bottle away from the tip of the brush. U.S. Pat. No. 1,193,433, which issued to T. J. Searcy on Aug. 1, 1916, discloses a bottle having a cap with an attached applicator brush. The opening of the bottle is angled rearwardly with respect to the bottle, such that the bottle must be tilted to direct the contents adjacent the applicator tip. U.S. Pat. No. 2,917,766, which issued to I. Ciffo on Dec. 22, 1959, discloses a hollow spherical bottle having a screw on cap with an attached applicator brush. U.S. Pat. No. 3,086,820, which issued to J. G. Baumgartner on Apr. 23, 1963, discloses a nail polish bottle which has a screw on cap and an applicator brush. The bottle has a generally frustoconical shape with a flat inner bottom wall.

While the above mentioned devices ar suited for their intended usage, none of these devices discloses a bottle having sloped interior walls to direct the contents adjacent the tip of an applicator. Additionally, none of the aforesaid patents disclose a bottle with an optional replaceable porous foam fingernail shaped applicator. Inasmuch as the art is relatively crowded with respect to these various types of bottles with applicators, it can be appreciated that there is a continuing need for and interest in improvements to such bottles with applicators, and in this respect, the present invention addresses this need and interest.

SUMMARY OF THE INVENTION

In view of the foregoing disadvantages inherent in the known types of bottles with applicators now present in the prior art, the present invention provides an improved bottle with applicator. As such, the general purpose of the present invention, which will be described subsequently in greater detail, is to provide a new and improved bottle with applicator which has all the advantages of the prior art bottles with applicators and none of the disadvantages.

To attain this, representative embodiments of the concepts of the present invention are illustrated in the drawings and make use of a bottle with sloped interior walls which direct the contents to the applicator tip. The applicator is a fingernail shaped porous foam tip which is attached to a shaft embedded in a snap on cap. In a first embodiment of the invention, the front exterior wall of the bottle forms a forty five degree angle with the exterior bottom surface of the bottle. In a second embodiment, the front exterior wall of the bottle forms a sixty degree angle with the bottom surface of the bottle. A screw on cap with an attached applicator brush is utilized in the second embodiment of the present invention. In a third embodiment, the applicator is in the form of an eye dropper type tube with an enlarged collector cavity adjacent a lower end. The applicator is actuated by a push button cap.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bottle with applicator which has all the advantages of the prior art bottles with applicators and none of the disadvantages.

It is another object of the present invention to provide a new and improved bottle with applicator which may be easily and efficiently manufactured and marketed.

It is a further object of the present invention to provide a new and improved bottle with applicator which is of a durable and reliable construction.

An even further object of the present invention is to provide a new and improved bottle with applicator which is susceptible of a low cost of manufacture with regard to both materials and labor, and which accordingly is then susceptible of low prices of sale to the consuming public, thereby making such bottles with applicators economically available to the buying public.

Still yet another object of the present invention is to provide a new and improved bottle with applicator which provides in the apparatuses and methods of the prior art some of the advantages thereof, while simultaneously overcoming some of the disadvantages normally associated therewith.

Still another object of the present invention is to provide a new and improved bottle with applicator for use with nail polish which has sloped interior walls to direct the contents to the applicator tip.

Yet another object of the present invention is to provide a new and improved bottle with applicator which utilizes a porous foam fingernail shaped applicator tip.

Even still another object of the present invention is to provide a new and improved bottle with applicator for use with nail polish which has a snap on cap with an attached applicator having recesses to facilitate manipulation of the applicator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
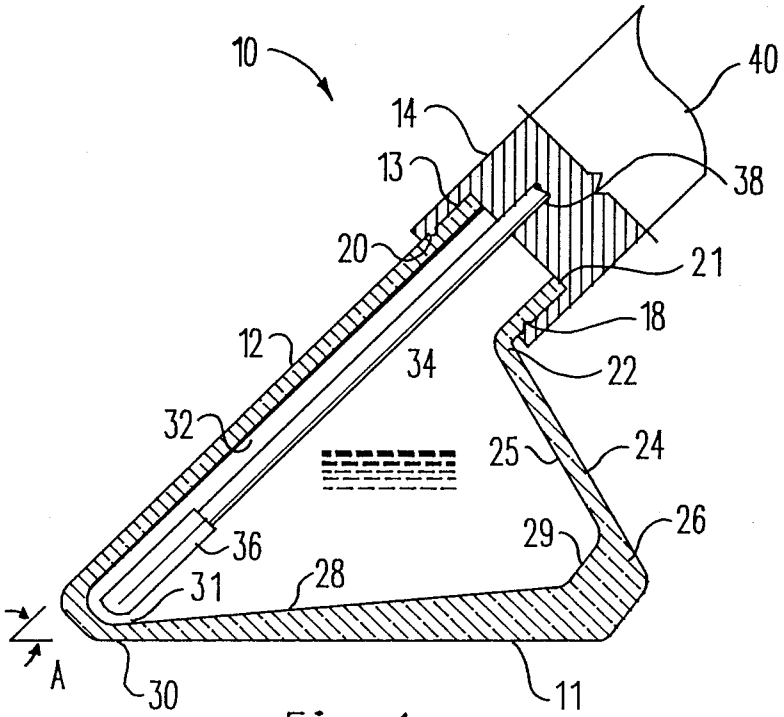
FIG. 1 is a cross sectional view of a nail polish bottle and applicator of the first embodiment of the present invention.

With reference now to the drawings, and in particular to FIG. 1 thereof, a new and improved bottle with applicator embodying the principles and concepts of the present invention and generally designated by the reference numeral 10 will be described.

More specifically, it will be noted that the first embodiment 10 of the invention includes a bottle with a sloping exterior front wall 12 having a snap on cap 14. A rectangular top portion 21 of the bottle is received within a rectangular recess 13 in the cap 14. A projecting ridge 18 in the recess 13 of the cap 14 engages a groove 20 around the exterior surface of the rectangular bottle top portion 21. This enables the cap 14 to be snapped on and off and provides an air tight seal for the content 16 of the bottle. A bottom exterior surface 11 of the bottle forms an included angle A of forty five degrees with the front exterior wall 12 of the bottle. The top rectangular portion 21 of the bottle is angularly joined at 22 to a sloping exterior back wall 24. The sloping exterior back wall 24 is joined by a short connecting wall 26 to the flat bottom surface 11 of the bottle. The exterior back wall 24 forms an angle of less than ninety degrees with the exterior bottom surface 11. The bottom wall 11 is joined by a short connecting wall 30 to the inclined front wall 12. The interior of the bottle has a sloped floor 28 which forms a small angle with the exterior bottom surface 11. The interior bottom surface 28 is connected by sloped wall 29 to a steeply inclined interior back wall 25. These inclined walls, in conjunction with the inclined front interior wall 32, serve to direct the content 16 of the bottle to a point 31 adjacent the applicator tip 36. Thus, the user does not have to manipulate the applicator tip 36 within the interior of the bottle in search of the remaining content 16. The applicator tip 36 is formed from a soft porous foam material and has a generally fingernail shaped configuration. The applicator shaft 34 has a top portion 38 embedded in the cap 14. The cap 14 has an upper curved end surface 40. The bottle is preferably formed from a glass material which may be tinted, transparent, translucent or opaque. For safety considerations, the bottle may be formed from a shatterproof material. The cap 14 is preferably formed from a somewhat resilient plastic material. This allows sufficient flexibility for sealing engagement of ridge 18 in the groove 20.

Figure 2:
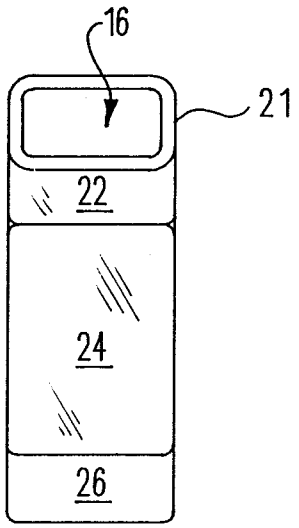
FIG. 2 is a rear view of the nail polish bottle of the first embodiment of the present invention with the cap removed.

With reference now to FIG. 2, the contents 16 are accessed through a rectangular opening in the rectangular top portion 21 of the bottle. The angularly sloping walls 22, 24 and 26 provide three separate inclinations to the back surface of the bottle.

Figure 3:
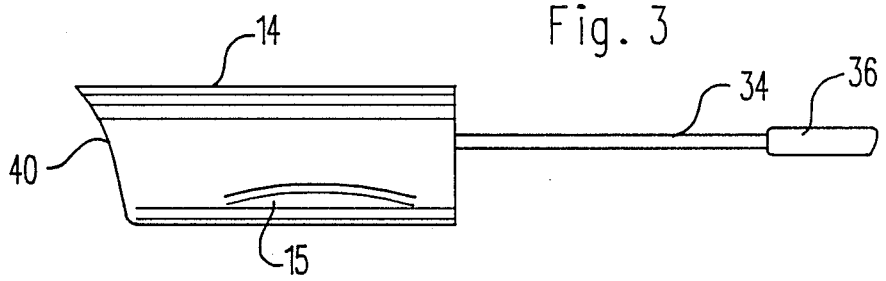
FIG. 3 is a side view of the applicator of the first embodiment of the present invention.

As shown in FIG. 3, the cap 14, which also functions as a handle for the applicator, has a pair of concave recesses (one of which is seen at 15) to facilitate grasping by a user.

Figure 4:
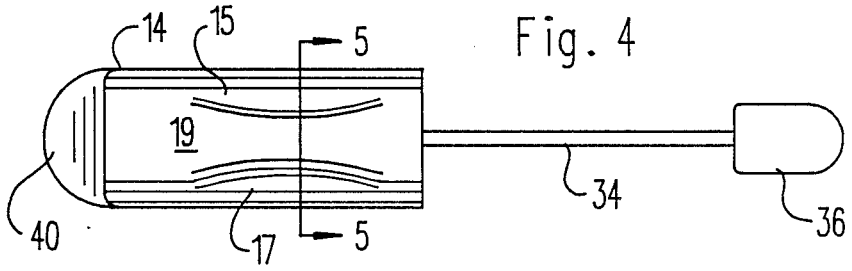
FIG. 4 is a bottom view of the nail polish applicator of the first embodiment of the present invention.

As seen in FIG. 4, a pair of concave recesses 15 and 17 are separated by a ridge portion 19 on the cap 14. These concave recesses facilitate grasping of the applicator by a user.

Figure 5:
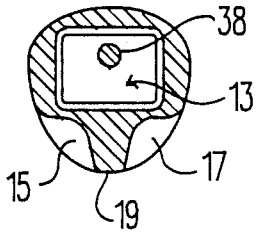
FIG. 5 is a cross sectional view taken along line 5—5 of FIG. 4 illustrating the construction of the cap portion of the applicator of the first embodiment of the present invention.

With reference now to FIG. 5, it may be seen that a rectangular recess 13 is formed in the lower end portion of the cap 14. This allows the cap to be received in surrounding engagement over the rectangular top portion 21 of the bottle. The configuration of the concave recesses 15 and 17 on opposite sides of the ridge 19 may now be understood.

Figure 6:
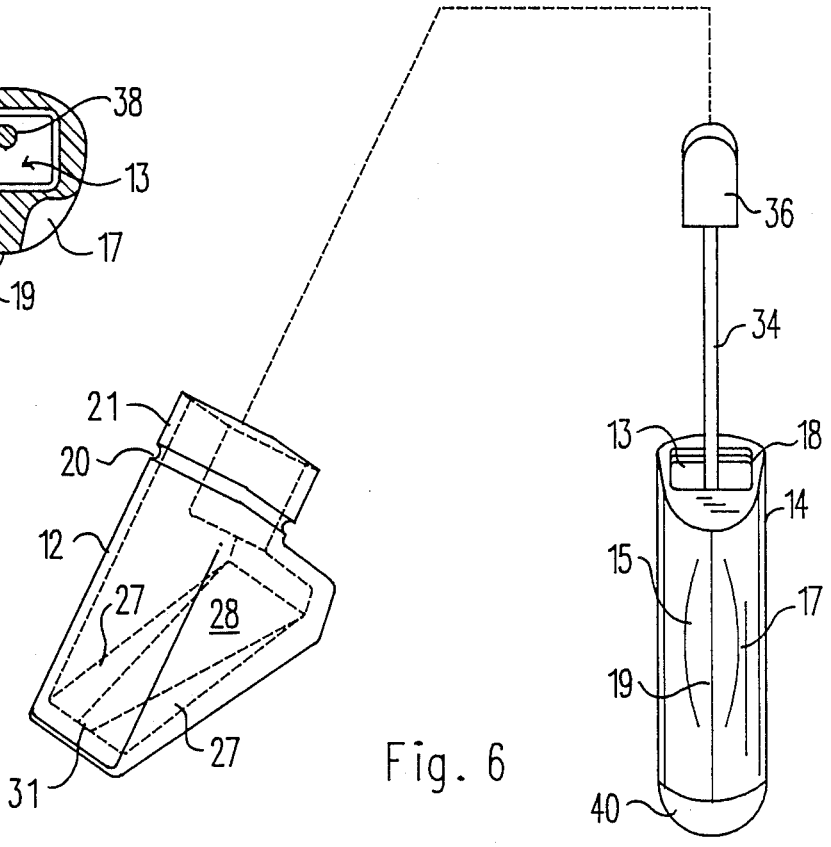
FIG. 6 is an exploded perspective view illustrating the nail polish bottle and applicator of the first embodiment of the present invention.

As shown in FIG. 6, the centrally inclined interior floor 28 of the bottle is sloped to direct the contents to a point 31 which is adjacent the applicator tip 36. Adjoining bottom portions 27 are also downwardly sloped to direct the contents to the point 31. It should be noted that the bottom interior surface of the bottle may be formed from three angularly related floor surfaces 27 and 28 as illustrated, or the interior side walls of the bottle may be sloped to direct the contents to the point 31. This choice depends upon the desired height to volume ratio of the bottle. As is now readily understood, the cap 14 has a rectangular recess 13 having a ridge 18 for reception in sealing engagement with the groove 20 formed around the top rectangular portion 21 of the bottle. In use, the cap 14 is merely inserted into the bottle where the sloping interior walls 27 and 28 will direct the contents of the bottle onto the porous foam applicator tip 36. The cap 14 is then withdrawn from the bottle, and the fingernail shaped applicator tip 36 is then applied against the fingernail to be painted, thus avoiding any brush strokes on the finished surface of the nail, as is common with conventional brush type applicators.

Figure 7:
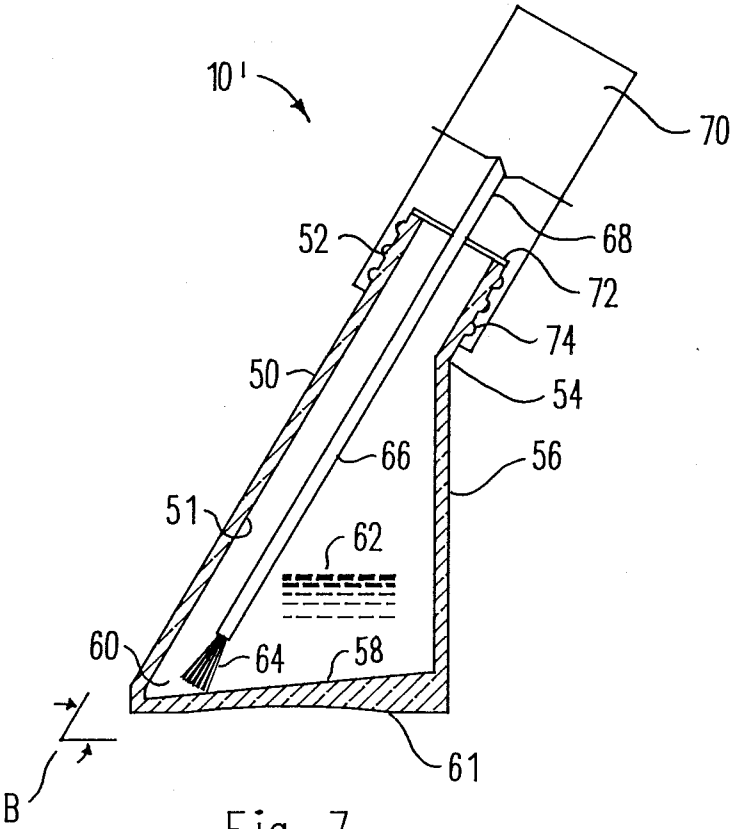
FIG. 7 is a cross sectional view of the nail polish bottle and applicator of the second embodiment of the present invention.

With reference now to FIG. 7, a second embodiment of a nail polish bottle and applicator 10' will now be described. The second embodiment 10' has an inclined outer front wall 50 which forms an included angle B of sixty degrees with a bottom surface 61. A straight back wall 56 forms a ninety degree angle with the bottom surface 61. A cylindrical upper portion 52 of the bottle is angularly connected at 54 to the straight back wall 56. The upper portion 52 is provided with threads which cooperate with thread 74 formed on the cap 70. The cap 70 is provided with a cylindrical recess 72 for the reception of the cylindrical upper portion 52 of the bottle. An applicator shaft 66 has a brush tip portion 64 and an end portion 68 which is embedded into the cap 70. A sloping interior front wall 51 and a sloping bottom wall 58 direct the contents of the bottle to a point 60 adjacent the brush rip 64.

Figure 8:
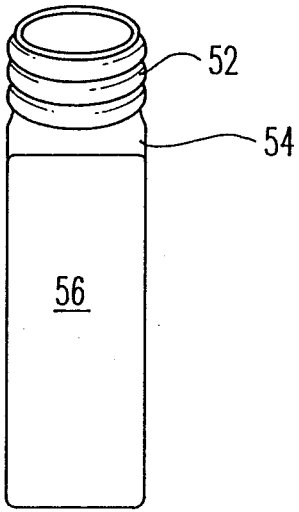
FIG. 8 is a rear view of the nail polish bottle of the second embodiment of the present invention with the cap removed.

With reference now to FIG. 8, a rear view of the bottle of the second embodiment or the present invention with the cap removed is provided.

Figure 9:
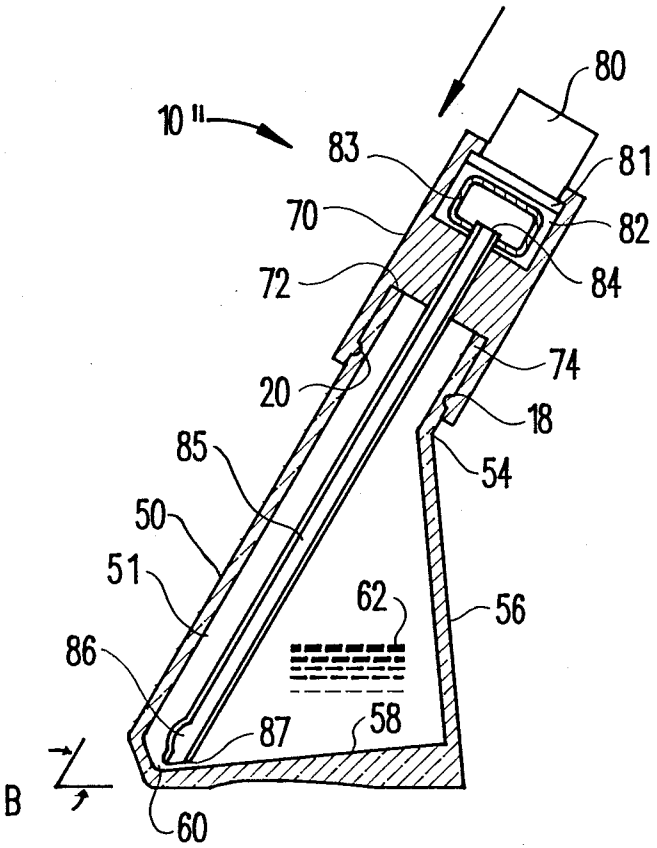
FIG. 9 is a cross sectional side view of the nail polish bottle and applicator according to a third embodiment of the present invention.

FIG. 9 illustrates a modified form of nail polish applicator according to the present invention. The bottle may be of the type illustrated in FIGS. 1, 2, and 6, or may be of the type illustrated in FIGS. 7 and 8. The cap may be the illustrated snap on type, or may alternatively be of the screw on type illustrated in FIG. 7. In either case, the upper portion of the cap 70 has an interior cavity 82 in which a flexible rubber bulb 83 is received A push button 80 is mounted for reciprocal longitudinal sliding movement in the cavity 82, and is retained by a radial circular flange 81. The resilience of the bulb 83 provides a return spring bias which urges the push button 80 to the illustrated extended position. An eye dropper type tube 85 has an upper end inserted into the bulb 83, and sealed therein by a radial flange 84. The lower end of the tube 85 has an opening 87 for the induction of nailpolish 62 from the bottle. An enlarged collection cavity 86 is formed adjacent the lower end of the tube 85 to retain a sufficient quantity of nailpolish to cover a nail surface. In use, the push button 80 is depressed and released to induct a quantity of nailpolish 62 into the tube 85 and collection cavity 86, the cap is removed from the bottle, and the push button 80 is depressed to dispense the nail polish on a nail surface.

Figure 10:
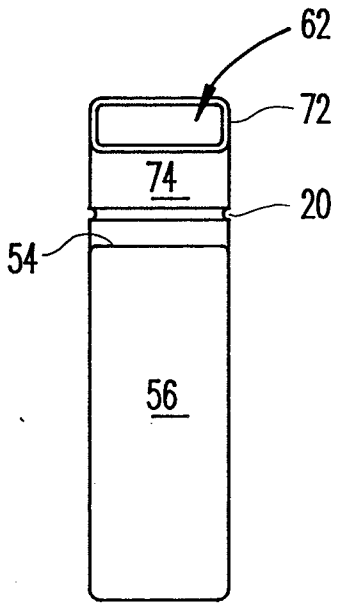
FIG. 10 is a rear view of the nail polish bottle and applicator of FIG. 9.

FIG. 10 illustrates a rear view of the bottle 10" of FIG. 9, with the cap removed.

Figure 11:
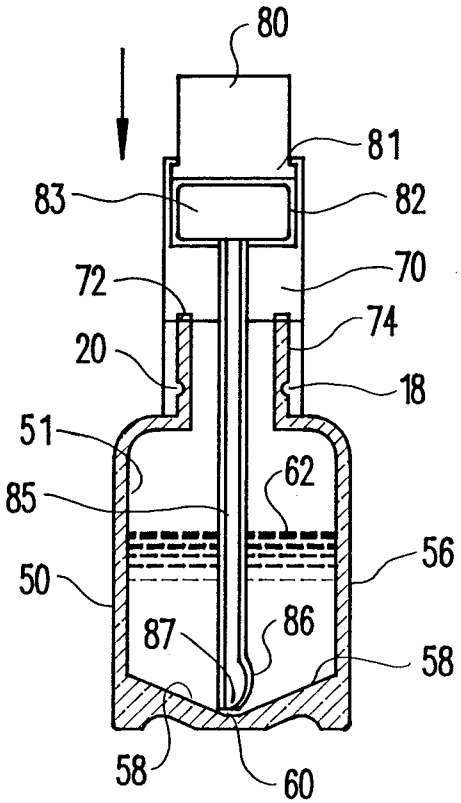
FIG. 11 is a cross sectional front view of the nail polish bottle and applicator of FIG. 9.

FIG. 11 is a front cross sectional view which illustrates the inclined interior floor portions 58 which converge to direct the fluid contents 62 to the front central portion 60 of the bottle 10".

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved bottle with applicator for use with nail polish, comprising:
- a bottle;
- said bottle having an inclined exterior front wall;
- a flat exterior bottom surface;
- said exterior front wall forming an angle of about 45 degrees with said exterior bottom surface;
- an interior front wall extending parallel to said exterior front wall;
- an interior bottom surface inclined downwardly toward said interior front wall and forming an angle with said exterior bottom surface;
- said interior bottom surface formed from three intersecting inclined planar surfaces, two of said inclined planar surfaces inclined downwardly and inwardly toward said interior front wall;
- an exterior back wall surface obliquely angled with respect to said exterior front wall surface and forming an acute angle with said exterior bottom surface;
- a generally rectangular top wall portion connected to said exterior front wall and said exterior back wall;
- first sealing means on said top wall portion;
- a cap having second sealing means for cooperating with said first sealing means; and
- an applicator attached to said cap.

2. The bottle with applicator of claim 1, wherein said first sealing means comprises a groove and said second sealing means comprises a ridge adapted to be received in sealing engagement with said groove.

3. The bottle with applicator of claim 1, wherein said applicator has a porous absorbent foam generally fingernail shaped tip.

4. The bottle with applicator of claim 1, wherein said applicator has a brush tip.

5. The bottle with applicator of claim 1, wherein said cap has a pair of concave recesses.

6. The bottle with applicator of claim 5, wherein said concave recesses are separated by a ridge portion.

7. The bottle with applicator of claim 1, wherein said cap is provided with a rectangular recess for receiving said rectangular top wall portion.

8. The bottle with applicator of claim 7, wherein said first sealing means comprises a groove extending around said rectangular top wall portion and said second sealing means comprises a ridge extending around said rectangular recess.

9. The bottle with applicator of claim 1, wherein said applicator comprises an eye dropper type tube having a bulb retained in a cavity in said cap.

10. The bottle with applicator of claim 9, wherein said cap includes a slidable push button for actuating said bulb.

11. The bottle with applicator of claim 9, wherein said tube has an enlarged collection cavity adjacent a lower end thereof.

12. A new and improved bottle with applicator for use with nail polish, comprising:

a bottle;

said bottle having an inclined exterior front wall;

a flat exterior bottom surface;

said exterior front wall forming an angle of about 60 degrees with said exterior bottom surface;

an interior front wall extending parallel to said exterior front wall;

an interior bottom surface forming an angle with said exterior bottom surface;

said interior bottom surface formed by intersecting planar surfaces inclined downwardly and inwardly toward said interior front wall;

an exterior back wall surface obliquely angled with respect to said exterior front wall surface and forming an angle of about 90 degrees with said exterior bottom surface;

a generally cylindrical top wall portion connected to said exterior front wall and said exterior back wall;

first sealing means on said top wall portion;

a cap having second sealing means for cooperation with said first sealing means; and an applicator attached to said cap.

13. The bottle with applicator of claim 12, wherein said first sealing means comprises a groove and said second sealing means comprises a ridge adapted to be received in sealing engagement with said groove.

14. The bottle with applicator of claim 12, wherein said applicator has a porous absorbent foam generally fingernail shaped tip.

15. The bottle with applicator of claim 12, wherein said applicator has a brush tip.

16. The bottle with applicator of claim 12, wherein said cap has a pair of concave recesses.

17. The bottle with applicator of claim 16, wherein said concave recesses are separated by a ridge portion.

18. The bottle with applicator of claim 12, wherein said applicator comprises an eye dropper type tube having a bulb retained in a cavity in said cap.

19. The bottle with applicator of claim 18, wherein said cap includes a slidable push button for actuating said bulb.

20. The bottle with applicator of claim 18, wherein said tube has an enlarged collection cavity adjacent a lower end thereof.

* * * * *